United States Patent [19]

Schulkin

[11] 3,985,354

[45] Oct. 12, 1976

[54] EXERCISE DEVICE WITH SPRING BIASED TELESCOPING MEMBERS

[76] Inventor: William Schulkin, 186 Riverside Drive - Apt. 5-A, New York, N.Y. 10024

[22] Filed: May 21, 1975

[21] Appl. No.: 579,570

[52] U.S. Cl. ..... 272/134; 272/142; 272/137

[51] Int. Cl.[2] ..... A63B 21/00

[58] Field of Search ..... 272/83 R, 82, 79 C, 272/136, 137, 138, 142, 134

[56] References Cited

UNITED STATES PATENTS

| | | | |
|---|---|---|---|
| 3,343,837 | 9/1967 | Grzybowski | 272/83 R |
| 3,359,802 | 12/1967 | Sollenberger | 272/79 C X |
| 3,768,808 | 10/1973 | Passera | 272/83 R X |

*Primary Examiner*—Richard C. Pinkham
*Assistant Examiner*—William R. Browne
*Attorney, Agent, or Firm*—Mandeville and Schweitzer

[57] ABSTRACT

A portable exercise device is provided which is completely self-contained, requiring an anchoring, bolting or other attachment to a wall, floor or other structure during use. The device is four sided, usually square, and may be readily dismantled for shipment or storage. The two uprights or vertically oriented sides of the device each include two concentric telescoping parts, spring-urged to cause one part to totally surround and encompass the other part. The top portion or action bar of the device is connected to one part of each of the uprights, and the base portion is connected to the other part of the uprights. The top and bottom portions are parallel to and movable relative to each other. The device is particularly appropriate for use in exercises where the bottom portion (base plate) is body-anchored, while the action bar is pulled or pushed for performing isometric exercises.

6 Claims, 2 Drawing Figures

EXERCISE DEVICE WITH SPRING BIASED TELESCOPING MEMBERS

STATEMENT AND BACKGROUND OF THE INVENTION

This invention relates generally to a portable exercise device. More particularly, this invention relates to a portable, four sided (advantageously square) exercise device which is simple in construction and lightweight, so that it may be readily manipulated by the exerciser in a variety of different exercise positions. Because of the portable and lightweight characteristics of the device, it may be "body-anchored" in the various positions in which it is used. That is, one of the two sides of the four sided device which is movable relative to an opposed side may be anchored to one portion of the body, while another portion either pulls or pushes against this body anchor. Therefore, the device eliminates the need for additional structure for supporting the device, or for any need to anchor it to other structures.

Previously, exercise devices useful for carrying out the type of exercises for which the instant device was developed either consist of relatively portable, but extremely heavy devices, such as bar bells, for example, or complicated exercise equipment involving a great deal of structure for anchoring the equipment so that it can be properly used. The latter includes freestanding arrangements with a heavy-duty base upon which are bolted complicated upright structures for supporting spring-biased slides, which slides, in turn, hold a movable bar which the exerciser moves in opposition to the springs.

With this invention, by contrast, a lightweight, four sided simple device is provided. Preferably, it is square, with each of the four sides being around 25–26 inches. The device is comprised of a relatively movable base plate and a top action bar connected by opposed spaced uprights, which are comprised of two telescoping parts. The top action bar is connected to one of the telescoping concentric parts and the base bar is connected to the other of the telescoping concentric parts. The telescoping parts in each of the uprights are interconnected with a heavy-duty, tightly coiled spring, which urges the telescoping parts into a totally concentric position with each other, with one of the parts being totally encompassed within the other part. Thus, the exerciser, in using the device, may anchor the base plate against one portion of the body, while pulling or pushing in an opposite direction on the top action bar in opposition to the body anchor. For example, the exerciser may lay on the base plate and push up on the top bar, as one exercise position for performing an isometric type exercise.

Because of the portability and lightweight nature of the device, it can be manipulated readily by the exerciser into a variety of different positions for different exercises of the body, as will be understood. Moreover, because of the simplicity of the construction of the device, in accordance herewith, it may be readily dismantled for storage and/or shipment, simply by disconnecting the four connecting bolts at each of the four corners.

Other objects and advantages of this invention will be apparent from the following description, the accompanying drawings, and the appended claims.

DETAILED DESCRIPTION OF THE INVENTION

Figure 2:
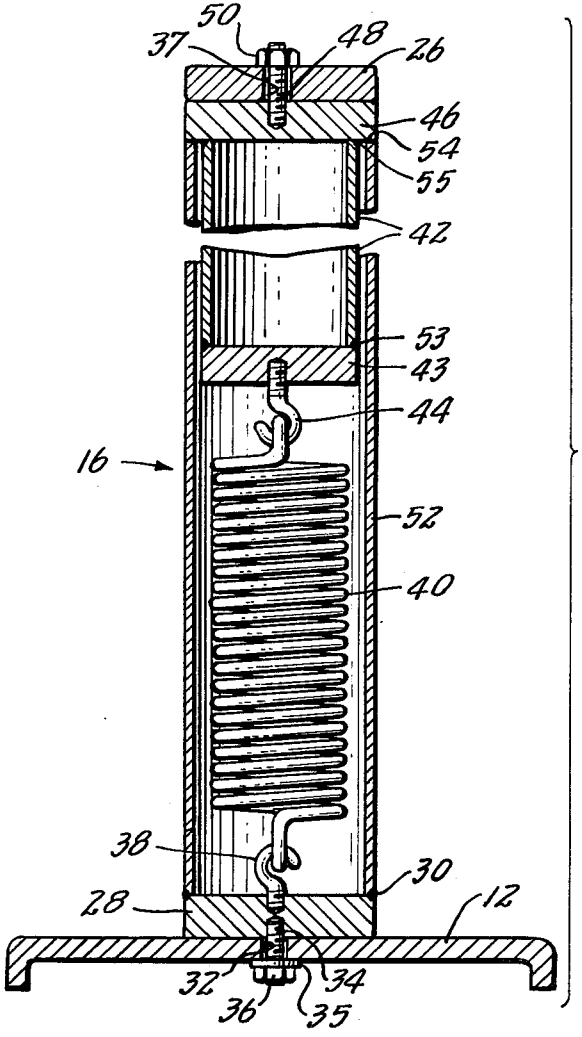
FIG. 2 is a sectional view taken along lines 2—2 of FIG. 1.
Figure 1:
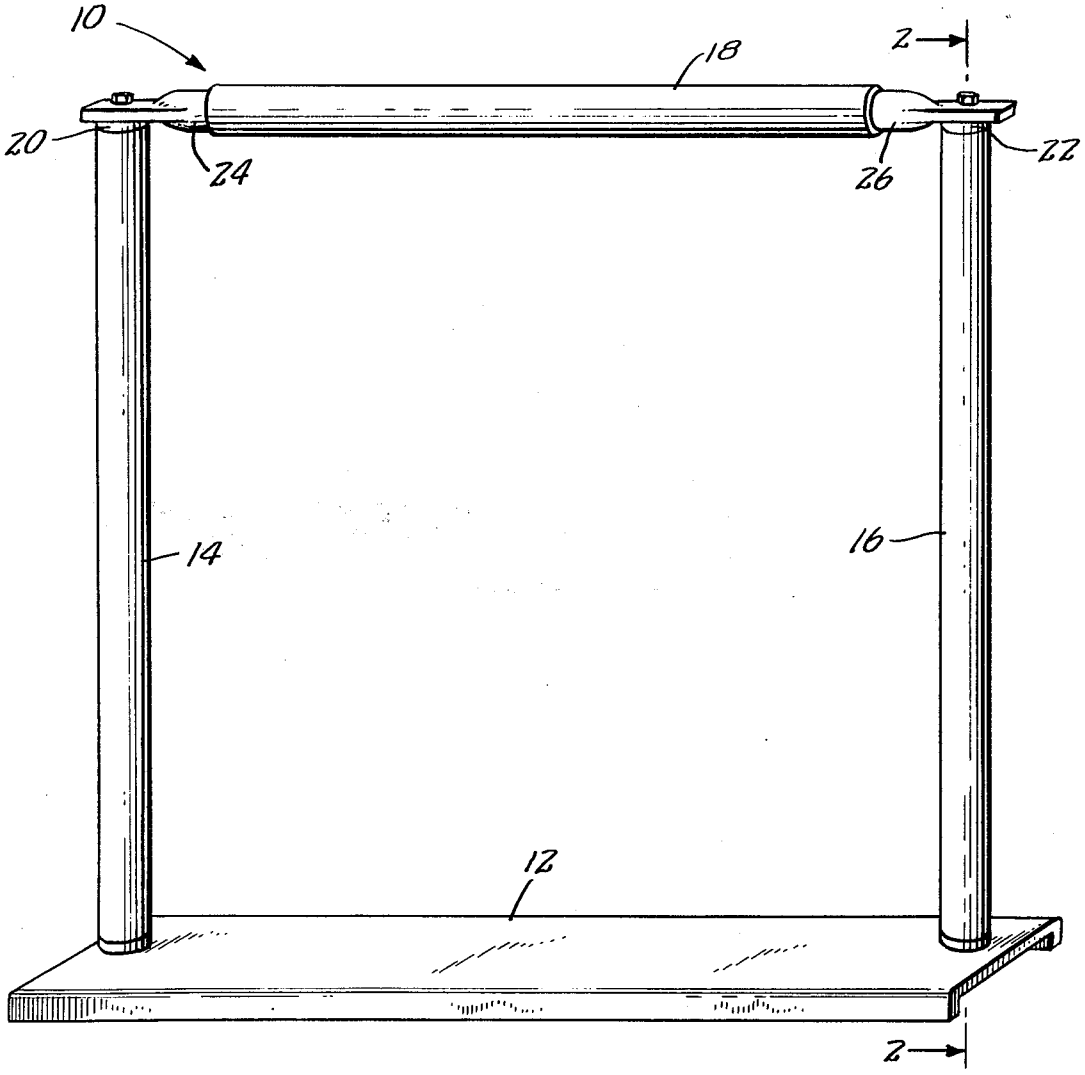
FIG. 1 is a front perspective view of an exercise device embodying the principles of the invention.

Referring to the drawings in which like reference characters refer to like parts throughout the several views thereof, 10 designates an exercise device generally, having a base bar 12, an opposed space top bar 18, connected by opposed parallel uprights 14, 16. Preferably, the base bar is comprised of a steel plate about ⅛ inch thick, although the base plate may be comprised of different materials, as long as it is capable of withstanding the stress involved in use as an exercise device. Top bar 18 is, preferably tubular, for easy grasping, with end connections 24, 26 at each end thereof, in the form of flat connecting ears with bores therethrough for connection to bolts on uprights 14, 16. The connections 24, 26 may be connected to top bar 18 by any means, including welding, press-fit frictional engagement, etc., as long as the connections, again, will withstand the stress involved in the use of the device. While base plate 12 is preferably a flat steel plate, it will be understood that it is within the purview of the invention to substitute a tubular steel bar similar to that of top bar 18. A flat base plate is preferred, however, because it is more useful in various exercise positions, particularly when used in connection with the exerciser's feet, back, etc.

Since the construction of uprights 14, 16 is identical, a description will be made only of upright 16. Thus, referring to FIG. 2, upright 16 is comprised of two relatively movable, concentric parts or elements 42, 52. As can be seen in FIG. 2, the dimensions of element 42 in section are slightly smaller than element 52, so that part 42 is readily movable within part 52. Moreover, element or part 52 completely surrounds the full length of element 42 in the position shown. Preferably, part 52 will be comprised of a steel tube having a bottom cap 28 connected thereto by any well-known means, such as a weld bead 30, for example.

As can be seen in FIG. 2, further, internal slideable part 42 has a bottom cap 43 and a top cap 46 connected at each end thereof, again by any well-known means, such as bead welds 53, 55, for example. As shown in FIG. 2, the cross sectional dimension of bottom cap 43 is the same as internal slideable part 42, while top cap 46 is the same dimension as outer part 52. Thus, as will be understood, part 42 is prevented from sliding into part 52 further than the position shown in FIG. 2, because top cap 46 has a circumferential edge which engages the top edge 54 of outer part 52.

Threaded into or otherwise connected to bottom cap 43 of internal part 42 is a hook 44 or other connecting device for engaging one end of a heavy-duty, tightly coiled spring 40 of diameter slightly less than that of the part 42, while the other end of spring 40 engages a second hook 38 screwed into or otherwise connected to bottom cap 28 of outer part 52. Thus, heavy-duty, tightly coiled spring 40 serves to urge sliding internal part 42 inwardly into outer part 52 in a concentric, totally surrounded telescoping manner.

Referring to the bottom portion of FIG. 2, cap 28 of outer part 52 is connected with base plate 12 by a bolt 34 passing through bore 32 of base plate 12, and screwed into cap 28. In order to hold the parts 52, 12 together, nut 36 is screwed onto bolt 34. Preferably, a washer 35 is used in order to maintain this connection in tight engagement.

A similar connection is arranged at the top of upright 16, in that a bolt 48 extends through a bore 37 of end connection 26 and is screwed into top cap 46 of element 42. A nut 50 is screwed onto bolt 48 for holding this connection together.

Thus, as will be apparent from the foregoing, when opposed forces are placed on the opposed parallel and spaced base plate 12 and top bar 18, so that base plate 12 and top bar 18 are moved away from each other, these forces will be directed against the heavy-duty springs 40 in each of the uprights 14, 16 for urging the internal parts or elements 42 upwardly in telescoping fashion out of the top of the outer parts 52. As internal parts 42 are moved further out of parts 52, gradually increasing force will be required under the opposing action of the combined heavyduty springs 40 in each of the uprights 14, 16. Of course, as soon as force is removed from the base plate 12 and the top bar 18, the telescoping parts 42, 52 of uprights 14, 16 will immediately return to the position shown in FIG. 2.

As will be apparent to practitioners in the art, the portability and relative simplicity of construction of the device enable the exerciser to utilize the device in many exercise positions. For example, top bar 18 may be pushed or pulled away from base plate 12, depending upon the position in which the device is being used. Moreover, as stated above, because of the comparatively lightweight construction and simplicity of the device, it may be used in body-anchored type of exercises with one part of the body opposing another part of the body in attempting to move base plate 12 and top bar 18 away from each other. The exerciser may stand on base plate 12 and grasp and lift top bar 18. Alternatively, the device may be positioned sideways, with base plate 12 in one hand and top bar 18 in another. As a further example of an exercise position, the exerciser may place the device to surround the body and position the base plate 12 against his buttocks, while pushing with the hands and arms against the top bar 18 in an opposed isometric type exercise.

In this connection, while the portability and lightweight nature of the exercise device of the invention here is especially appropriate for body-anchored type exercises, it should be understood that it is within the purview of this invention that the device can be temporarily anchored against or around other structure which may be available for further exercises. For example, base plate 12 may be positioned behind a pole, and the exerciser may then grasp top bar 18 and pull the top bar 18 away from base plate 12, anchored on the opposite side of the pole.

Aside from the advantageous lightweight, portable characteristics of the device herein, it will be appreciated from the above description that the device, because of its simple construction and nature may be readily dismantled into four pieces simply by unscrewing the pairs of nuts 36, 50. It will be appreciated, further, because of this simplicity of construction and the "self-contained" nature of each of the four parts of the device, that it may be manufactured rapidly and easily using conventional mass production techniques.

While the form of apparatus herein describes and constitutes a preferred embodiment of the invention, it is to be understood that the invention is not limited to this precise form of apparatus, and that changes may be made therein without departing from the scope of the invention, which is defined in the appended claims.

For example, appropriate tension adjustment arrangements may be included between the telescoping parts of the vertical uprights in order to increase or decrease the initial tension on springs 40. Alternatively, this adjustment may be made by appropriate threading of hooks 38, 44 in their corresponding supports 28, 43, as will be understood.

I claim:

1. A four sided portable exercise device comprising
a. a pair of elongated, parallel spaced aprat elements movable relative to each other;
b. a pair of elongated, parallel spaced apart telescoping connecting members;
c. one of said connecting members connecting one end of each of said elements, and the other of said connecting members connecting the other end of each of said elements;
d. each connecting member comprising a first outer part connected to one of said spaced apart elongated elements and a second inner part connected to the other of said spaced apart elongated elements;
e. said first and second parts being concentric, with said second part slideable internally of said first part; and
f. resilient means in said first part, said resilient means interconnecting said first and second parts of each of said connecting members to bias said second part toward said first part during the movement of one of said elongated elements, during an exercise program.

2. The device of claim 1, in which
a. each of said elements and said connecting members are of equal length.

3. The device of claim 1, in which
a. each of said connecting members are tubular in form.

4. The device of claim 1, in which
a. one of said spaced apart elongated elements is a flat base plate; and
b. the other of said elements is tubular having flat connecting ears at each end for connection with each of the second inner parts of said connecting elements.

5. The device of claim 1, in which
a. each of said resilient means is a heavy-duty spring interconnecting one end of said first part with the adjacent one end of said second part.

6. A portable exercise device comprising
a. an elongated base plate;
b. an elongated tubular top bar, said top bar being parallel to and spaced apart from said base plate;
c. a tubular telescoping connector bar connecting each of the ends of said spaced apart base plate and top bar;
d. the inner telescoping part of each connector bar being connected to said top bar, and the other telescoping part of each connector bar being connected to said base plate; and
e. spring means disposed in each said connector bar between said inner and said outer telescoping parts to bias the top bar toward the base plate during an exercise program.

* * * * *